US006842114B2

(12) United States Patent
Billiard

(10) Patent No.: US 6,842,114 B2
(45) Date of Patent: Jan. 11, 2005

(54) WIRE-BASED SAFETY DEVICE FOR THE DETECTION OF THE THEFT OF AN OBJECT TO BE PROTECTED AND OPERATING METHOD

(75) Inventor: Jean-Pierre Billiard, Luce (FR)

(73) Assignee: SAAA-Systemes d'Automatismes d'Alarmes Automiques, Gallardon (FR)

( * ) Notice: Subject to any disclaimer, the term of this patent is extended or adjusted under 35 U.S.C. 154(b) by 76 days.

(21) Appl. No.: 10/292,433

(22) Filed: Nov. 13, 2002

(65) Prior Publication Data

US 2003/0122672 A1 Jul. 3, 2003

(30) Foreign Application Priority Data

Nov. 13, 2001 (FR) ..... 01 14670

(51) Int. Cl.[7] ..... G08B 13/14

(52) U.S. Cl. ..... 340/568.1; 340/568.2; 340/571; 340/572.1; 235/128

(58) Field of Search ..... 340/568.1, 568.2, 340/571, 572.1–572.9, 941, 933, 505, 551, 552; 235/128; 335/229, 205

(56) References Cited

U.S. PATENT DOCUMENTS

| | | | | |
|---|---|---|---|---|
| 4,213,110 A | * | 7/1980 | Holce | 335/207 |
| 4,536,754 A | | 8/1985 | Holce et al. | 340/568 |
| 5,172,098 A | * | 12/1992 | Leyden et al. | 340/568.2 |
| 5,714,934 A | * | 2/1998 | Sasagawa et al. | 340/568.3 |
| 5,748,083 A | | 5/1998 | Rietkerk | 340/568 |
| 5,790,020 A | * | 8/1998 | Sasagawa et al. | 340/572.1 |
| 5,995,003 A | * | 11/1999 | Rogers | 340/568.4 |
| 2001/0022552 A1 | | 9/2001 | Maloney | 340/568.1 |

* cited by examiner

*Primary Examiner*—Phung Nguyen
(74) *Attorney, Agent, or Firm*—Young & Thompson

(57) ABSTRACT

An electronic wire-based safety device for the detection of a theft of an object to be protected, the device including at least one detector connected by a wire-based electric link to a signalling unit, the detector being arranged in relation with an object to be protected, the detector exhibiting at least a first electrical status in relation with the object and a second status when the object is detached from the detector, the unit including at least one threshold voltage comparator with inputs/outputs whereof one input is connected to the detector by the link and whereof at least one output indicates by signals at least the presence or the absence of the object in relation to the status of the detector.

19 Claims, 12 Drawing Sheets

* : Num corresponds to a digital interrogation (active detector communicating)

Start

Reading the detectors

Processing of Type 1

Vn = Value of measurement
Vn = mean of the preceding measurements
DVn = mean of the preceeding measurement of fault
C = count the number of measurements carried out before signaling a fault Processing of Type 2

Processing of Type 3

Type 4' Processing

Processing of Type 4

Processing of Type 5

WIRE-BASED SAFETY DEVICE FOR THE DETECTION OF THE THEFT OF AN OBJECT TO BE PROTECTED AND OPERATING METHOD

TITLE OF THE INVENTION

BACKGROUND OF THE INVENTION

The invention concerns a wire-based safety device for the detection of a theft of an object to be protected. Its finds its main applications in commerce where objects are exposed to the consumers' desire in order to signal a theft or an attempt to stealing said object. The invention also concerns an operating method of the device.

DESCRIPTION OF THE RELATED ART

Wire-based safety systems against theft are known. They implement generally a detector comprising a sensor and arranged fixed to an object to be protected and connected by wires to a signalling unit which determines the status of the detector by measuring the voltage applied to the wires and, in particular, if it is either fixed on the object or detached. In case when the detector is detached, an alarm is generally triggered in order to attract the public's attention and the personnel's attention. Such a system is for example described in the patent application EP-116701 on behalf of OTT.

Currently, wire-based safety systems as a whole use a micro-switch as a sensor, which is integrated to a box which is stuck to the product to be protected either directly via an adhesive or thanks to a sticking sole in order to disconnect the detector of the product without needing to change the adhesive each time.

The safety of these detectors is ensured either by a loop as in 4-wire systems in association, or not, with a two-colour light-emitting diode to indicate visually the status of the system, or by a third wire placed at a potential so that, once connected to the other wires, it triggers an alarm in case of short-circuit as in 3-wire systems, or safety is not ensured at all. In both first cases, this protection is called a circuit-puncture protection.

The main problem associated with 4-wire protection is the cost, except when associated with a light-emitting diode that may serve as a status indicator of the sensor which enables advantageously to determine at first start-up whether the detector is present and whether it is stuck or not.

The shortcoming of the conventional three-wire system used with a micro-switch lies in that fact that it cannot determine the presence of the detector if the latter is not stuck on the product when the facility is switched on for the first time.

In all cases of use, if the thief knows the colour of the wires connected to the switch, fraud is possible. A means to remedy this shortcoming consists in using sheathing materials which are particularly resistant, which renders the operation far longer and more complicated for thieves, even if it does not make the system inviolable.

Another limitation of these known systems is that it implements detection ranges with fixed voltages which provides a limitation as regards the electric characteristics of the detector for the statuses that it may encounter. The number of types of usable detectors is therefore necessarily reduced which increases the risk that an ill-willed person knows these characteristics rather quickly and may simulate the presence of a sensor of a detector and the presence of the object by tampering with the system, let alone, use the material collected or stolen from another place.

Moreover, the current systems should implement rather wide detection ranges to take into account all the possible deviations in the value of the components and voltages with the passing of time (ageing of the components for example) or in relation with the environment (temperature coefficient of the components for example), which also reduces their inviolability since it is then possible to inject a substitutive voltage or to apply a load, whereof the value is less restrictive, on the link to simulate the presence of the detector and of the object.

SUMMARY OF THE INVENTION

The purpose of the invention is therefore to enable to solve these problems and to obtain a system which is reliable while avoiding false detections, for example due to drifts, and reacting efficiently to attacks such as attempts to steal the object or tampering attempt for a reduced cost while remaining polyvalent.

To this end, the invention concerns an electronic wire-based safety device for the detection of a theft of an object to be protected, the device comprising at least one detector connected by a wire-based electrical link to a signalling unit, the detector being arranged in relation with a object to be protected, the detector exhibiting at least a first electrical status when it is in relation with the object and a second electrical status when the object is detached from the detector, the link transmitting the electrical status to the unit in the form of a set voltage on the link, the unit comprising at least one threshold voltage comparator with inputs/outputs whereof at least one input is connected to the detector by the link and whereof at least one output indicates by signals at least the presence or the absence of the object in relation to the electrical status of the detector.

According to the invention the link comprises two wires whereof a first is connected to a common point and the second is connected via at least one first resistor to a voltage generator with respect to the common point, the second wire being connected to the input of the comparator, the comparator comprises an analogue digital voltage converter for digital measurements of the voltage and a digital calculation central unit depending on an operating programme enabling the generation of the signals in relation to the digital comparison between the measurement and digital reference thresholds.

The term 'set voltage' corresponds to substantially continuous voltage (for example a detector comprising a passive sensor of the switch type and resistors) as well as a variable voltage (for example a detector comprising an electronic <<communicating>> chip transmitting digital binary data) and the association of both (for example a detector associating a switch and an electronic <<communicating>> chip). The digital reference thresholds for the generation of the signals in relation to the statuses depend therefore on the type of the set voltage, in the first case, exceeding one or several thresholds (for example output from a detection window corresponding to a given status) and in the second case, in addition to the previous thresholds, absence of data or data outside the expected values for a given status.

In various embodiments of the invention, the following means possibly combined according to all the technically possible configurations are employed:

- the comparator implements detection windows delineated by digital reference thresholds, each window corresponding to a given status of the detector, the digital reference thresholds are proportional to the voltage of the voltage generator, the voltage generator is a fixed voltage regulator, the voltage generator is a variable voltage regulator controlled by the calculation central unit, the variable voltage regulator is an analogue digital converter, the digital reference thresholds are preset digital values in the case of a voltage generator which is a fixed voltage regulator, the digital reference thresholds are digital values proportional to the measurement results of the generator voltage by the analogue digital converter, the digital reference thresholds are proportional to a mobile average calculated on a set number of digital measurements of the voltage of the link, (the term proportional for the digital reference thresholds corresponds in practice to fractions of the value of the generator voltage or, in the case of averaged measurements of the link, to fractions and multiples of the calculated average since the system is arranged so that the voltage of the link is produced by a resistive voltage divider in the case of a passive circuit and/or by a current or voltage absorber/generator in the case of an active circuit. Indeed, in the case of digital reference thresholds linked with averaged measurements, it appears that it is also possible to define these thresholds as multiples of the average, since this average is already the result of an analogue division of the generator voltage by the first resistor and the active or passive load provided by the detector)

the digital reference thresholds are proportional at the same time to measurements of the voltage of the link (single or mobile average) and of the generator voltage, (preset digital or measured), the link comprises two ends, the first end being connected to the unit and the second end to a detector, the link comprises a means for connection to/disconnection from the unit, the detectors are removable, the link comprises a means for connection to/disconnection from to the detector, the link comprises two ends, the first end being connected to the unit and at least one detector being plugged at a point of the link, said plugging ensuring electric connection between the wires of the link and the detector, the device comprises several links, each links comprising at least one detector, (a link may therefore comprise several detectors)

in the case of several links and/or of measurement of the generator voltage, preferably the device further comprises one analogue multiplexer upstream of the analogue digital converter, in the case of several links, the first resistor is arranged between the voltage generator and the second wire linking the input of the analogue digital converter and the analogue multiplexer, the detector is passive and the electric statuses are created by variation of the resistor of the detector, the detector comprising a second resistor in series with a sensor which is a switch in mechanical relation with the object, the assembly being connected between both wires of the link, the passive switch detector comprises besides a third resistor between both wires of the link, in parallel with the assembly, in order to enable the generation of at least a third status linked with the absence/presence of a detector on the link and in that the signals at the output of the comparator indicate besides the absence or the presence of the detector on the link, the switch is mechanically operated (micro switch) or magnetically operated (lamp with 'reed' type flexible blades, a magnet being arranged in relation to the object), the detector is passive and the electrical statuses are created by variation of the resistor of the detector, the detector comprising a sensor which is a connector of two wires of the link and intended to be connected to a socket of the object to be protected, the socket of the object exhibiting a load resistance, the detector is passive and the electrical statuses are created by an active electronic circuit contained in the object to be protected, said circuit being connected to a socket of the object and the detector comprising a sensor which is a connector of the two wires of the link and intended to be connected to a socket of the object to be protected, the detector is passive and the electrical statuses are created by the communication with an electronic communicating system integrated to the product to be protected, the detector comprising a sensor which is a connector of two wires of the link and intended to be connected to a socket of the object to be protected, the socket of the object exhibiting a link with the electronic system internal to the product to be protected, (the communicating part is therefore integrated to the product), the passive connector detector comprises besides a third resistor between both wires of the link in order to enable the generation of at least a third status linked with the absence/presence of detector on the link and in that the signals at the output of the comparator indicate besides the absence or the presence of the detector on the link, at least the value of the first resistor is taken randomly from a range of values, the device comprising means to determine the thresholds, at least the value of the second resistor is taken randomly from a range of values, the device comprising means to determine the thresholds, at least the value of the third resistor is taken randomly from a range of values, the device comprising means to determine the thresholds, the detector is active and the electrical statuses are created by an active electronic circuit, the detector comprising at least a Hall effect sensor in relation with a generator of static magnetic field fixed to the object to be protected, the detector active with Hall effect sensor(s) shows a power supply current causing a voltage drop detectable in the first resistor in order to enable the generation of at least one third status linked with the absence/presence of detector on the link and in that the signals at the output of the comparator indicate besides the absence or the presence of the detector on the link, (in this type of configuration, one may possibly do without a resistor between both wires of the link since at least the active circuit is itself already a load which signals its presence on the link by the current that it draws, thereby creating a difference of potential at the terminals of the first resistor)

the detector active with Hall effect sensor(s) comprise(s) besides a third resistor between both wires of the link in order to enable the generation of at least a third status linked with the absence/presence of detector on the link and in that the signals at the output of the comparator indicate besides the absence or the presence of the detector on the link, the detector is active and comprises at least a communicating electronic chip with power supply, transmission and reception of binary data on 2-wire-based link, the detector with a communicating electronic chip comprises a switch in mechanical association with the object and which is in series with the chip on the link, the detector with a communicating electronic chip comprises besides a resistor between both wires of the link in order to enable the generation of at least a third status linked with the absence/presence of detector on the link and in that the signals at the output of the comparator indicate besides the absence or the presence of the detector on the link, the detector with a communicating electronic chip comprises besides a second chip between both wires of the link in order to enable the generation of at least a third status linked with the absence/presence of detector on the link and in that the signals at the output of the comparator indicate besides the absence or the presence of the detector on the link, the device comprises means to determine the type of each detector of a given link during the first installation of the link and/or of each addition or withdrawal of detector or when resetting, the device comprises means to determine the digital reference thresholds for the link during the first installation of the link and/or of each addition or withdrawal of detectors or when resetting, the electric power supply of the active detector is ensured by the 2-wire-based link, the electric power supply of the active detector is ensured by an additional wire in the wire-based link with recall of said power supply by a common wire, the wire-based link comprises at least one additional wire in order to supply at least one light-emitting diode in the detector, the light-emitting diode reflecting at least one output status of the comparator, with a single additional wire the power supply of the diode is fed back over a common wire, the diode is of both-colour type by inversion of the polarity of its power supply voltage with respect to the common point, the signalling unit is connected by a computer link to a control central unit.

The invention also concerns an operating method of a theft detection device comprising at least one detector connected by a wire-based electrical link to a signalling unit.

The method in question is employed on the previous device and according to one or several of the listed characteristics and the voltage of the link is converted into a digital value and said value is compared to at least one digital reference threshold in order to produce signals in relation to the status of the detector.

The operating method may also be developed according to all the implementation modalities of the forms of the device as listed above.

In particular:

during an initialisation or addition/withdrawal phase of detectors, detection windows are determined, delineated by digital reference thresholds for the statuses transmitted by the link of a detector, the digital reference thresholds are determined for a link and a given detector from a mobile average of measurements performed on said link and said detector for a given status, in addition, the type of each detector of a given link is determined during the first installation of the link and/or of each addition or withdrawal of detectors or when resetting, in addition, the digital reference thresholds are determined for the link during the first installation of the link and/or of each addition or withdrawal of detectors or when resetting, the interest shown by the consumer in the product is followed up, the interest corresponds to at least one or several of the following actions of the consumer: taking the product in his/her hand, operating the product, duration of interest shown, date and hour of the interest shown.

It is also possible to implement random resistance values from a range of values for the detectors, the device determining the thresholds during the installation of each detector.

The advantages of the analogue/digital solution suggested are, among others, as follows: cost reduction, improving the level of safety while diminishing the number of false triggerings, possibility of using with the same unit detectors of various types (passive or active). It is also possible with a simple switch to know the status of the detector when being inserted on the protection system. The implementation of an analogue digital converter and of a digital calculation unit enable real-time tracking of the variations in electrical statuses generated by the detector and following the drifts which show generally high time constant.

The characteristics of the components used possess tolerances and drift with the passing of time or in relation to external physical phenomena such as temperature. The use of calculation algorithms based upon the concept of the mobile average enables to get rid of these problems. In a preferred mode, mobile average of the ADC measurements, the calculation algorithms work with respect to the ADC measurements variations and not with digital absolute values. It is thus possible to move the detection window (the thresholds) of a status in relation to the slow variations of said status (mobile average), the quick variations outside the window causing the output of the digital comparator to toggle. The device being able to determine the thresholds, the device may implement detectors whereof the electrical statuses can be selected randomly, whereas the values of resistors implemented are taken at random from a range of values. It becomes thus impossible to determine the characteristics of a detector after analysing the other detectors. It is also possible to connect, through the link, a sensor whereof the type may be passive or active and even in the latter case of active and <<communicating>> type (an electronic chip being able to converse with the central unit) without it being necessary to modify the interface between the line and the central unit, the analogue digital converter being able to measure variable voltages corresponding to a transmission of digital data by a <<communicating>> active sensor. The manufacture of the detectors becomes less cumbersome as regards the value of the components. Interchangeability of the detectors of different characteristics by a user is also simplified. Whereas the detectors may exhibit different characteristics, it is also possible to determine the location (link) of a given detector and of a given object, whereby the detectors can be suited to the protection of specific objects.

Similarly, the digital averaging of the input value for the determination of the detection thresholds enables efficient filtering of the electrical disturbances that may be carried by the wire-based link which is generally little charged. It is thus possible to obtain rejection of the 50 Hz or 60 Hz industrial frequency while performing analogue/digital conversions regularly according to a frequency multiple of the 50 Hz or 60 Hz and while averaging the measurements obtained. The digital processing performed on the ADC measurements enables to do away with EMC disturbances, rapid transients in particular. The use of calculation algorithms based upon the concept of the mobile average enable in particular to minimise the influence of rapid transients.

BRIEF DESCRIPTION OF THE DRAWINGS

This invention will be understood better when reading the following embodiment examples wherein.

DESCRIPTION OF THE PREFERRED EMBODIMENTS

Figure 1:
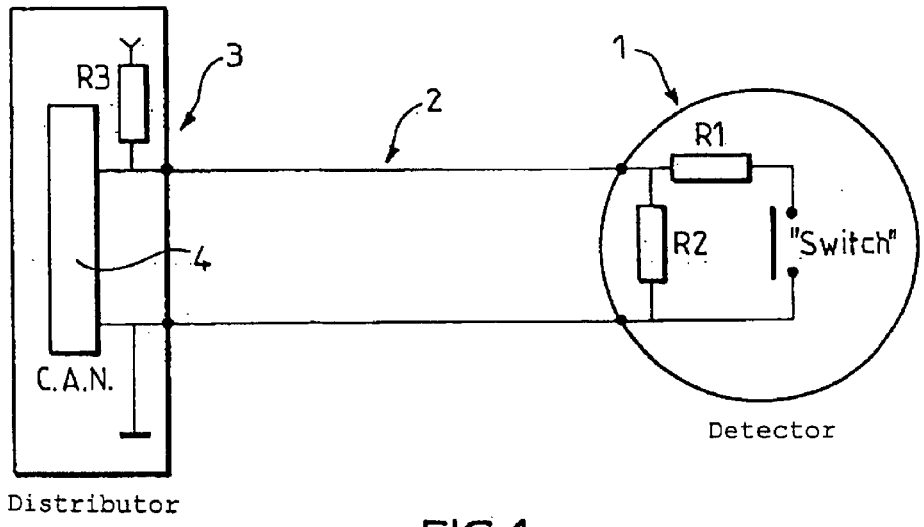
FIG. 1 represents a basic application of the invention.

FIG. 1 corresponds to a circuit with a unit or distributor comprising an analogue digital converter, or ADC, connected by a two-wire link to a passive detector which comprises a sensor which is a switch. The first wire connects the ground of the ADC to one of the contacts of the switch (<<switch >>), the second wire, via a resistor R1, connects the input of the converter to the other contact of the switch. The arrangement of the switch in series with R1 may be reverted with respect to the ground wire. Between both linking wires lies a resistor R2. The input of the converter possesses a resistor R3 for bringing back to the reference potential produced by a voltage generator and intended to form a dividing bridge with the assembly (R1+switch in series)//R2, situated in the detector. Such a configuration enables the detection of the presence/absence of the object and of the presence/absence of the detector.

In other words, on FIG. 1, the detector 1 comprises a switch and a resistor R1 in series on a resistor R2 in parallel on a 2-wire link 2 connected to a signalling unit 3. Such a configuration enables the determination of statuses of presence or absence of the object in relation to the switch as well as the presence or absence of the detector. Indeed, the link 2 is connected on the one hand to a voltage source via a resistor R3 and on the other hand to a common point, the assembly with the detector forming a voltage divider.

If the detector is not connected to the system and therefore if the input of the converter is not connected to the switch, the level of voltage is then identical to the reference voltage and the system considers that no detector is connected since the voltage drop in R3 is negligible, the analogue digital converter 4 having very high input impedance with respect to the resistors of the device, among which R3. When the detector is installed, R2 shunts a portion of the current of the link and the voltage drop increases, thereby signalling the presence of the detector. When the object is in relation with the detector, whereas the switch is closed, the voltage drop is increased still further since R1 and R2 are then in parallel. Finally, if short-circuit is attempted, the voltage drops to zero and the current is delineated by R3. To these different possibilities correspond detection windows of the statuses delineated by thresholds. In the device, there exists at least one detection window of presence of objects (digital thresholds), any measurement outside the window corresponding to an anomaly signal at the output of the digital comparator. Other windows can also be managed by the central unit and in particular, absence/presence of the detector; short-circuit.

The figures do not represent the digital circuits for the production of status signals. These circuits are conventionally a microprocessor- or microcontroller-based central unit with sufficient memory for an operating programme (typically ROM, EPROM, EEPROM) and for storing data (RAM saved or not, EEPROM). Preferably, one uses a microcontroller with integrated analogue digital converter and, if possible in certain embodiments with a variable voltage generator, at least one digital analogue converter, DAC. In cases where such a converter is not available in a microcontroller, it is possible to use binary digital outputs of the microcontroller connected to a network of resistors R-R/2 followed by a low impedance output operational amplifier to simulate an DAC and to obtain a programmable voltage. The advantage of an DAC for a given link is to be able to adapt the generator voltage to the type of detector of said link. In case when several links are implemented, the preferred embodiment implements an analogue multiplexer at the input of the signalling unit as represented and explained at a later stage on FIG. 6. In other embodiments, each link may have its own DAC or a device with a single DAC+an analogue multiplexer and a holding analogue circuit by a link (a holding sampler enabling to maintain an analogue voltage for a set duration), enables to generate as many voltages as links.

The advantage of implementing a voltage generator which may be controlled by programme, an DAC, lies on the other hand in the possibility of adapting the voltage on the link to reduced consumption suited to the load brought by the sensor and/or to power supply voltage suited to an active circuit of a sensor and/or to cause this link voltage to evolve in order to make the tampering attempts of the detector and/or of the link more difficult and finally, in the case of an <<intelligent>> active circuit of a sensor, to transmit digital data to said sensor in the form of a modulation of the voltage of the link.

In short, as regards FIG. 1, if the switch is connected to the system but with 'open contact' i.e. not stuck to the product, the dividing bridge formed by R3 and R2 gives a voltage which lies in a preset zone and known as corresponding to a status connected but detached. For exemplification purposes, R2 is a resistor whereof the value is fixed and whereof the ratio with R1 is at least equal to 3 for the highest thereof. If the switch is connected to the system with 'closed contact' i.e. stuck to the product, the dividing bridge is performed thanks to R3 and R2 in parallel with R1 whereof the value may vary in a ratio of 10 and gives a voltage value on the link whereof the level will lie in a range acknowledged by the comparator as being a detector present and stuck to an object.

According to a variation wherein one may not detect specifically the absence of the sensor with respect to a stolen object, one may omit R2.

When the detector is connected and acknowledged as stuck, the system measures the voltage at the terminals, determines detection thresholds and follows up the drift so that said drift cannot generate an alarm due for example to an increase or decrease in the temperature. In a preferred embodiment, following-up is ensured by averaging a number of previous measurements performed, i.e. a mobile average. In less performing a mode, only the last measurement performed can be taken into account for the determination of the thresholds. It will be easily understood that following up this threshold concerns essentially a detector present on an object available and that any output from the window thus determined is an anomaly. Following up the other statuses may however also be performed by mobile average, whereas a change of status may signify that a user installs an object or a link with detector or a new detector. The implementation of a follow-up and in particular of a mobile average of digital measurements of the link enables to use narrow windows thus limiting tampering possibilities.

In case when a thief attempts an intrusion on the system, it may be of three orders:

short-circuit between the wires, cutting one or both wires, baring the wires and putting a voltage source in parallel.

In the case of short-circuit, the potential at the terminals of the converter becomes nil and therefore lower than the minimum threshold of the normal operating window and generates an alarm.

In case when one of the wires is cut, the potential at the terminals of the converter becomes equal to the voltage of the voltage generator or reference potential and therefore greater than the maximum threshold the normal operating window and generates an alarm.

In case when a voltage source is put in parallel, the thief must first of all check the voltage at the terminals of the detector which it energises since, the value of R1 being a random one, he may not rely on a test performed previously on another detector. Once this value is known, he must install an accurate voltage source (<0.1V) with as small as possible an internal resistance since sudden variation of approx. ten millivolts may suffice to trigger the alarm in the case of a narrow window. This latter case is highly improbable in a manned shop and fitted with video-surveillance systems.

Figure 2:
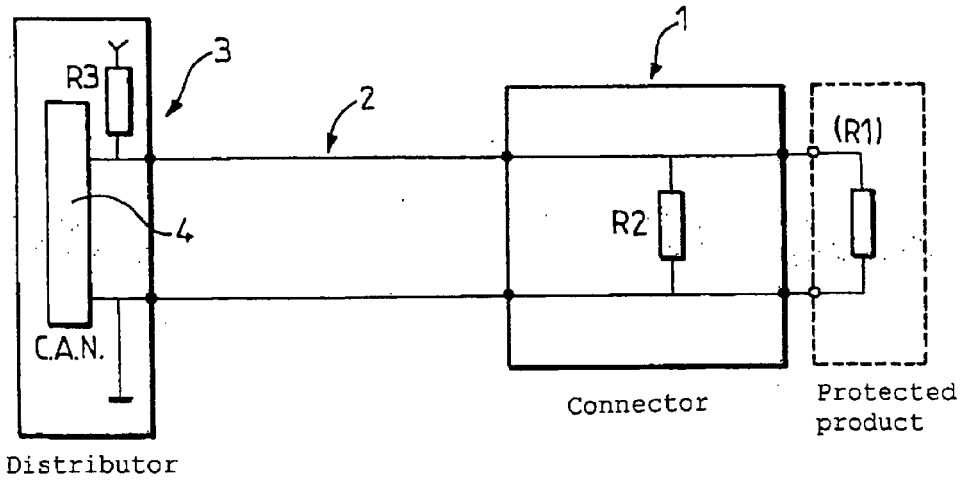
FIG. 2 represents an application to an object possessing a socket.

The principle of analogue detection may be extended according to FIG. 2 without requiring a switch for the protection of any electric, electronic or computer apparatus with an electric interface with an internal impedance compatible with the range of values of R1, the resistor R2 is placed directly in parallel with the impedance of the system to be protected in case of connection and, as in the previous case, serves to provide the detection of the status of the detector which is not connected. The major interest of such a solution is to do away with a detector stuck to the product thanks to connection to an electric, electronic or computer socket which is not used in demonstration mode. This type of detector is passive.

Other applications can be the protection of products liable to move within restricted limits thanks to a magnet 5 associated with an active detector comprising an analogue Hall effect sensor which measures the field of the magnet and which in case of field variation outside preset limits will generate a voltage which itself will lie outside the range acknowledged as that of a normal operation. These applications are represented on FIGS. 3 to 5. Any action on the linking wires of the sensor will be, as in the previous cases, interpreted as an intrusion and will therefore generate an alarm.

This type of Hall effect sensor possesses an active element sensitive to a magnetic field. Associated with a magnet, it enables for example to control the opening of doors (applications in shop windows). It may be used with a two-wire cord. There exist two types of useable Hall effect sensors within the framework of the invention, the analogue sensors whereof the output is a substantially linear function of the field applied (or other function: logarithmic, sigma . . . ) and two-state 'all or nothing' sensors.

The Hall effect sensors being active electronic circuits, a power supply source is necessary. It may be provided by a third wire on the link with recall on the wire of the common point as on FIG. 3. The power supply of the sensor may also be provided by a two-wire link as on FIG. 4. In the latter case, it can be understood that the voltage at the input of the regulator 6, although variable in relation to the response of the sensor, should not drop below the lower limit in order to regulate a voltage with output Vreg. For example if Vreg is 5 Volts, the voltage drop at the terminals of the regulator is 2 Volts minimum, one determines R3 so that the voltage between both wires of the link does not drop below 7 Volts during variations of the output of the Hall effect sensor.

Figure 5:
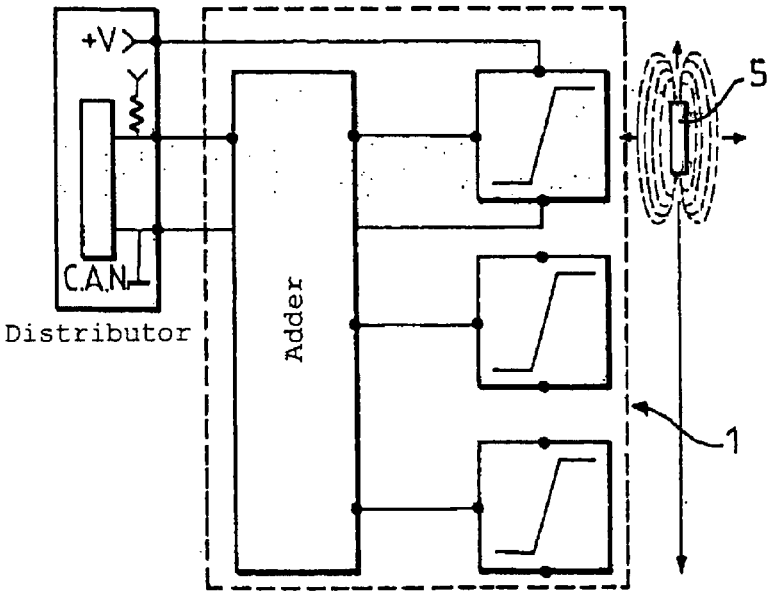
FIG. 5 represents the implementation of a detector with Hall effect sensor according to a third mode.

Within the framework of the Hall effect detection, with detector active, FIG. 5, a variation may be contemplated by using two or three Hall effect 'All or Nothing' sensors. The principle consists in using several detectors at different positions, which enables to give information of different levels in relation to the displacement of the magnet. In case of summing due to the use of a more powerful magnet, the voltage generated will lie outside programmed or calculated values, exceeding the thresholds, and therefore lead to an operation similar to that of an analogue sensor for a price that may be lower, taking into account the higher prices of analogue detectors with respect to 'All or Nothing' detectors.

Similarly, within the framework of the follow-up of the displacement of the object with respect to a detector, it is possible to use active detectors using tag radio type sensors (<<tag RF>>) arranged on the object and transceiver in the detector, the level of detection giving information on the distance of the object with respect to the sensor.

Active <<communicating>> electronic circuits such as electronic identification chips liable to communicate digital binary data by a two-wire series link and having a specific identity or address can also be used in the detectors. Their use corresponds to the realisation of active detectors according to the assembly principle of FIG. 1 but when the resistor R1 is replaced with such a chip, whereas R2 may be kept or not, or replaced also with another chip. Such a chip may also be implemented according to the principle of FIG. 2 but where R2 is replaced with said chip. However, in the latter case, the own electric characteristics of the socket of the product (whereas the socket can generate a signal or data) should be taken into account to avoid any electric or functional incompatibility.

The <<communicating>> chip modulates the voltage of the link preferably at the request of the signalling unit. The ADC of the signalling unit having sufficient acquisition frequency of the signal, either equal to the modulation frequency of the chip to perform a measurement by modulation cycle (measurement synchronised approximately at the middle of each cycle) if the latter is known a priori, or at least twice the modulation frequency. Preferably, the <<communicating>> chips do not transmit data on the link, modulate the voltage of the link, only upon request of the signalling unit and it is thus possible either to synchronise the acquisitions, or to increase momentarily the acquisition frequency to be able to measure and reconstitute the data transmitted to the signalling unit. The data request by the signalling unit is based upon the modulation of the voltage generator. The request corresponds to the transmission of binary digital data of the signalling unit to the detector(s) of a link and preferably a DAC is implemented for the voltage generator. In less evolved a mode, the voltage generator is a fixed voltage regulator controlled in 'All or Nothing' mode. In the case of active detectors with a <<communicating>> chip, thresholds corresponding to the presence or the absence of data from said chips can also be taken into account by the central unit.

The advantage of the active detector with a <<communicating>> chip is to enable the dissociation of the statuses <<Detector DETACHED>> and <<Detector DISCONNECTED>> contrary to the All or Nothing detector. When operating a detection central, the detached detectors can therefore be identified. However, the duration to establish the communication with an identification chip reduces the maximum number of detectors of the same type which may be managed by the same signalling unit or a same distributor according to the embodiment. This number must be sufficient to guarantee a reasonable scanning duration of the links.

It is possible to implement links in the form of cables whereof the ends comprise connectors intended to be connected to a first end to the unit and to the second to the sensor. It is thus possible to offer several lengths of link for the same detector. As the device can detect the absence of the detector, a theft attempt with disconnection of the detector of the link will also be signalled specifically (third resistor implemented for specific detection of the absence of detector) or not (either because the object is detached from the detector or the detector is detached from the link). According to a variation, the detector is connected directly to the link and a single connector is arranged of the side of the unit on the wire-based link.

To sum up the different sensors that can be used in the detectors and the corresponding detection possibilities (presence/absence of the product=P; presence/absence of the sensor or cutting the link=C):

1—passive sensor:
- a—switch on its own: P;
- b—switch with resistor in series: P;
- c—switch with resistor in series and a resistor in parallel on the assembly: P+C;
- d—connector on the object with input resistor of the object: P;
- e—connector on the object with resistor in parallel in the detector: P+C;

2—active sensor:
- a—Hall type active sensor (or active <<intelligent>> sensor in series with a switch) whereof the power supply current is sufficient to create a difference of potential that can be measured and detected by the unit on the first resistor: P+C;
- a'—in the reverse case (power supply current too small): P except if a resistor is arranged in parallel;

According to a variation a <<communicating>> chip in series is available with a switch and a second <<communicating>> chip in parallel on the assembly: P+C (equivalent to the 1-*c*, of the <<communicating>> chip in lieu of the resistors). According to other variations, one or several resistors are replaced with <<communicating>> parts and/or the input resistor of the object with a communicating part. These different possibilities, although they enable the detection of the theft are however not all equivalent as regards the protection against tampering. In practice, the solutions 1-*c*, 1-*e*, 2-*a* and 2-*a*' with resistor in parallel on the link are preferred, which enables more status detection possibilities. Therefore, passive (analogue) detectors are available (switch+resistors for example), as well as active analogue detectors (Hall effect sensor for example; 'All or Nothing' for instance), or active digital detectors (comprising a communicating chip).

The implementation of an ADC enables also the detections of other statuses than the minimum detection of presence of the object, associated or not to the detection of the presence status of the detector and, in particular of statuses of use of the product, whereas the term use may correspond to holding the item in the hand or operating the product. It becomes thus possible, on top of the basic safety function (detection of the theft), to implement the device for marketing purposes (follow-up of the consumer's interest for a given product for instance). In this view, in the case of passive detectors, a second switch can be available for detecting an item that hand held or moved (switch sensitive to displacements mercury or, preferably, ball switch) with a resistor in series, whereas this assembly is in parallel on said item (with its resistor), for detecting the presence of the object.

In the case of passive detectors with connector on the object, the voltages generated by the apparatus can be detected during its operation. According to a variation, a detector of the type 1-*a* or 1-*b* or 1-*c* can be combined with a connector on the object (in parallel with the detector of the previous type), the connector enabling the determination of the operation of the object. Thanks to the implementation of an ADC in the case of an object possessing a socket, it is also possible to consider the operation of the object. Indeed, the object in question may be an electronic device, a play station, a computer or other, whereof the socket shows in operation defined statuses, for example for a socket in series RS232 a voltage of + or −10 volts. The unit may also determine said statuses and consider that the presence of such voltages is also normal. This latter operating status may also be signalled by the unit in case when one seeks to know the interest shown by the consumers in a given product, whereas operating the product is a sign of such interest. The socket may be a USB socket which also presents preset statuses. Preferably, the unit will determine these additional statuses of detection during an initialisation phase with operation of the object.

In the case of application of the device to the protection of an object with a socket with input impedance and fitting a connector of the link, it is advisable that the voltage sent to the socket should be as little as possible and, if possible with high impedance, to avoid over voltages or to send a current that can be detrimental in the object. It is contemplated in particular to send a voltage lower than the function threshold voltage of conventional solid state electronic circuits and, for instance, smaller than or equal to 0.6 Volt for silicium. In such a case, means for amplifying the signal of the link before conversion by the ADC can be provided if the resolution of the latter is not sufficient.

According to a variation enabling to follow up the consumers' interest in the object, said follow-up, instead of being performed downstream in the signalling unit, may be carried out upstream within a specialised circuit arranged in a given point of the link, possibly in the detector itself, and recording the statuses linked to holding the item in the hand or using the object. The specialised circuit is arranged between both wires of the link. Such an arrangement upstream of the signalling unit enables to limit the software impact caused by the addition of this specific follow-up functionality within the unit. According to this variation, there is provided on the link, between both wires, in the detector or at a distance from said detector, an electronic <<intelligent>> chip capable of recording data from the signalling unit in order to store the uses of a given object. Thus, a third <<intelligent>> chip connected in parallel with the other two will enable to read the status of the displacement sensor (digital, analogue or All or Nothing).

The statistical information associated with computer processing enables to provide the client with a marketing analysis on the products left to be hand held on display. Each manipulation of a product will be memorised by the computer, then plotted in graphic format (tendency curve versus hourly periods, . . . ).

Conventional protection means (grid composed of diodes, of Zeners, R/C, varistors, fuse, relays . . . ) against electrostatic discharges and surges can also be provided at the input of the unit. The sensor may also comprise surge protections.

The circuits and software packages implemented in the signalling unit are conventionally a microprocessor circuit. On the other hand, the Figures concern a single detector but it is also possible to implement a battery of detectors and of links. In the case of several links, each link has its own resistor for connection to the voltage generator in order to avoid the interferences between the different links, for example a short circuit on a link should not affect the others.

Besides, as narrow detection windows can be implemented; it is contemplated to have several products protected on a single link, the values R1 and R2 respective enabling to define specific intermediate statuses of the voltage of the link for each detector.

The signalling unit may be a single box or be modular in the form of an array of boxes interconnected between them according to any typology allowed by the use of the microprocessor-based computer tool: tree structure, ring, linear . . . It is thus possible to have specialised boxes arranged at different locations, a control and operating box being arranged in a protected location, a signalling box arranged in the premises where the protected objects are placed, a specific box for connection to the links in case when it is distinct from the signalling box.

According to an embodiment, the signalling unit comprises input/output type means for initialisation, activation or inactivation of a link, whereas the activation may enable the determination of the thresholds of said link and sensor (s). According to the application, the inputs/outputs can be simple: switch associated with one or several light indicators, a light-emitting diode preferably, for signalling the statuses for instance, or more sophisticated, such as computer screen, keyboard, and display in the form of coloured icons, for instance.

According to a preferred alternative embodiment, the signalling unit, called distributor, comprises essentially a microprocessor or microcontroller with ADC and voltage generator (regulator or DAC) and the inputs/outputs for initialisation, activation or inactivation or others, are offset towards a remote control and operating station with computer communication between both.

The computer programme implemented in the unit may comprise means facilitating the determination of the thresholds. It is for example contemplated that in an object initialisation phase, the user activates several times the object contact or moves the object away from the detector and determines thus the object presence/absence thresholds, whereas a sound or light signal can be transmitted to signal the end of the process. Indeed, the unit is generally situated at a distance from the object and it is preferable to avoid moving back and forth with respect to the object, its detector and the unit. Such an operation may also be implemented in the case of the presence/absence thresholds of detector in a similar fashion. Finally, in a sophisticated embodiment, the user may have a radio or infrared remote control unit for remote control of the unit and manual initialisation or reset. According to a basic operating mode, one determines simply the thresholds in relation to the status presence of the sensor+object. In a more advanced alternative, one also considers the presence and absence statuses of the sensor on the link.

Figure 6:
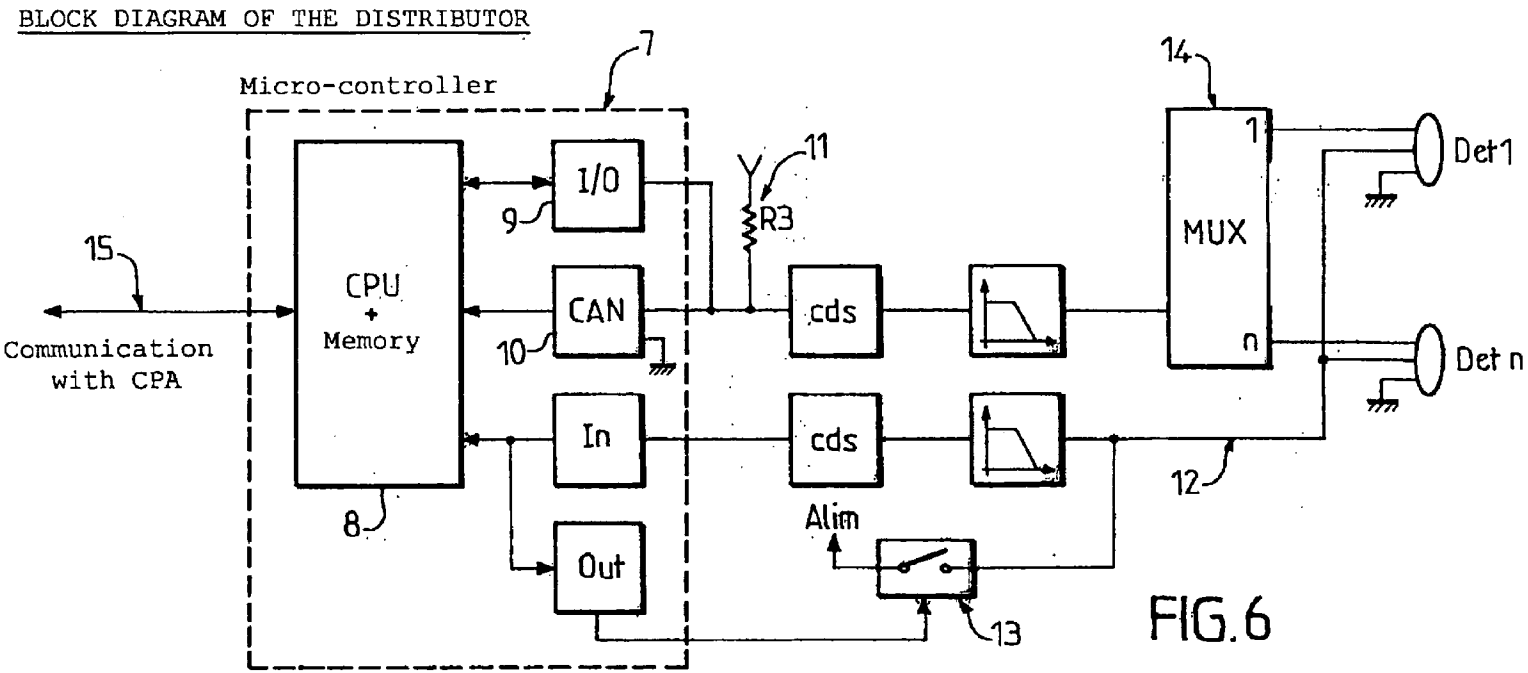
FIG. 6 represents a diagram of a device according to the invention.

FIG. 6 represents a preferred embodiment of the invention as regards the signalling unit. In this mode, the signalling unit is a distributor which communicates to a control central unit not represented by a two-direction computer link 15. The distributor comprises a microcontroller 7 with a central processing unit (CPU) and memory 8, the memory being intended on the one hand to store an operating programme and on the other hand variables necessary for running this programme, in particular thresholds. An ADC 10 and inputs/outputs (I/O 9 or IN/OUT) are also available. A reference voltage is sent via a resistor R3, 11, towards the ADC and a linking wire via safety and filtering devices (cds: signal conditioner) and a multiplexer 14 enabling the selection of a link among several (n links). In this configuration, the resistor is time-shared by multiplexing the corresponding wire between the different links. The link comprises a second wire connected to the ground, common point. In such an embodiment, a third wire 12 for power supply is available on each link. The power supply by this third wire 12 is controlled by a controlled gate 13 and it is possible to measure in All or Nothing mode, by means of the input IN, the voltage available or not on this third wire and in particular in the case of a short-circuit or of the response of a communicating circuit in case when said circuit sends data back over this third wire. However, the ADC as explained previously may also enable the reception of data on a two-wire link. The modulation from the dispatcher for a data demand may take place either via the inputs/outputs 9 or thanks to a controlled gate 13.

Figure 7:
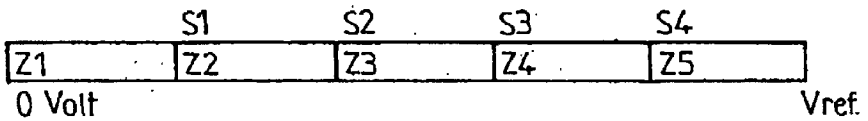
FIG. 7 represents the relations between zones, thresholds and voltages of a link.

FIG. 7 gives a representation of the relations between the detection zones (windows) noted Zx (x=1..5 in this example), the thresholds noted Sx (x=1..4 in this example) and the analogue voltage on the link which may be comprised between 0 Volt and Vref. (Vref. corresponding to the voltage of the voltage generator) in relation to the possible statuses of the detector(s).

The following FIGS. 8*a* to 8*h* correspond to operating algorithms of the device exemplified previously with a distributor and a central unit. A digital detector is a detector which comprises at least one communicating chip which can respond on the link when the latter is interrogated. An analogue detector may be passive (switch and resistors for instance) or active (Hall effect sensor for instance). An active communicating detector is also called a digital detector. The measurements correspond to acquisitions of the signal (voltage) of the link considered by the ADC which provides digital results of measurements M or data according to the type of detector. For simplification reasons of the explanation, it has been considered that each link may comprise one detector maximum. However, by modification of the algorithm, it is also possible to take into account more than one detector on the same link.

Figure 8A:
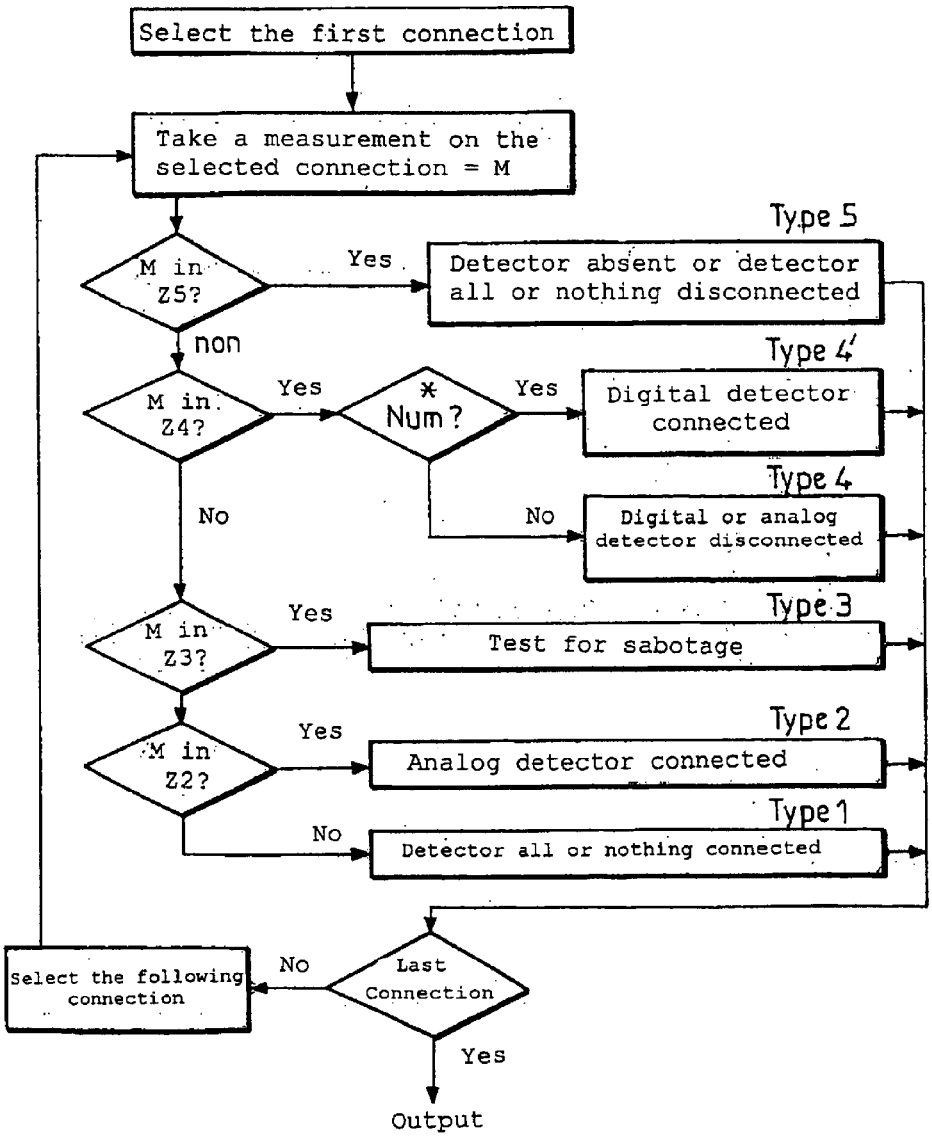
FIGS. 8*a* to 8*h* represent operating algorithms of the device.
Figure 8B:
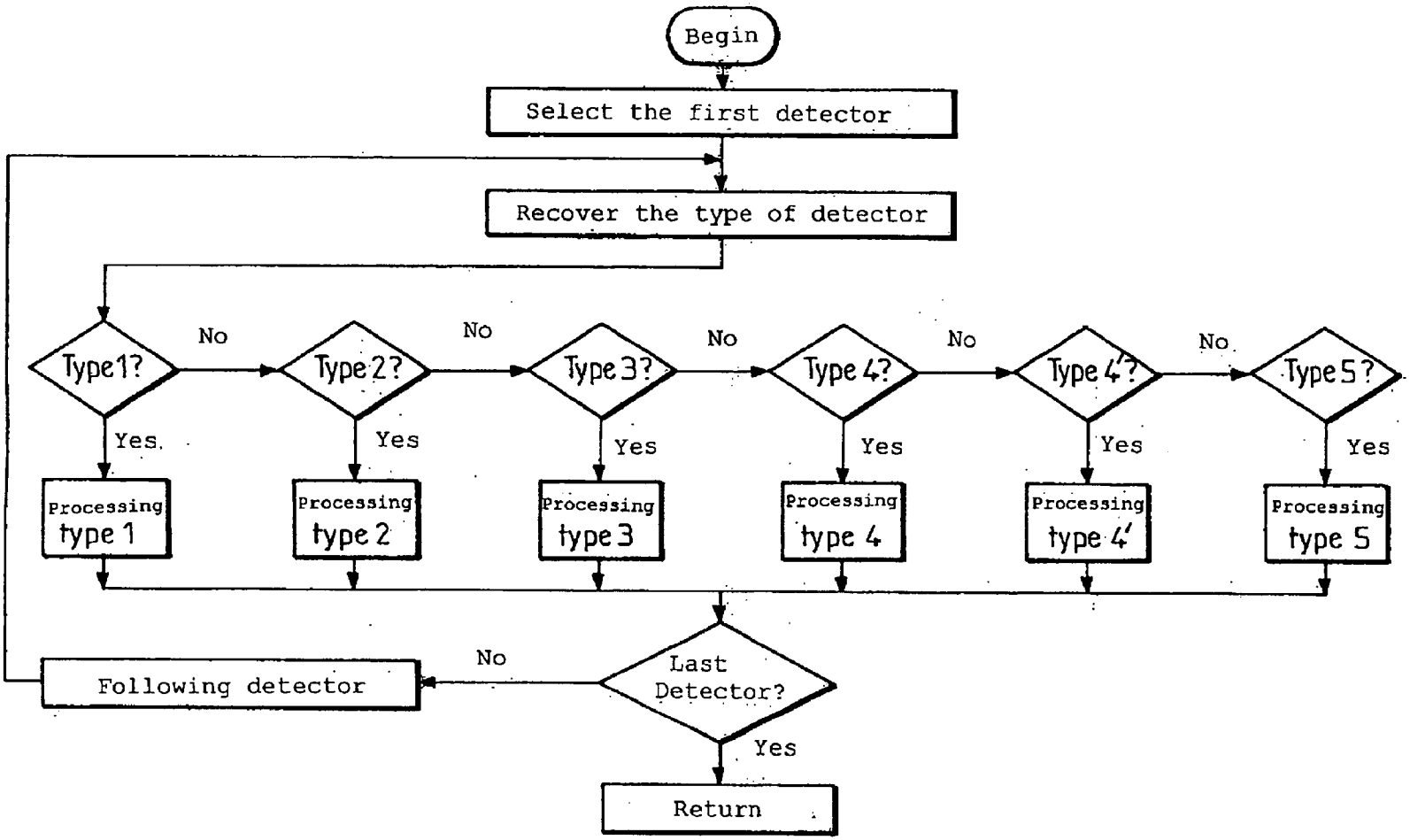
Figure 8C:
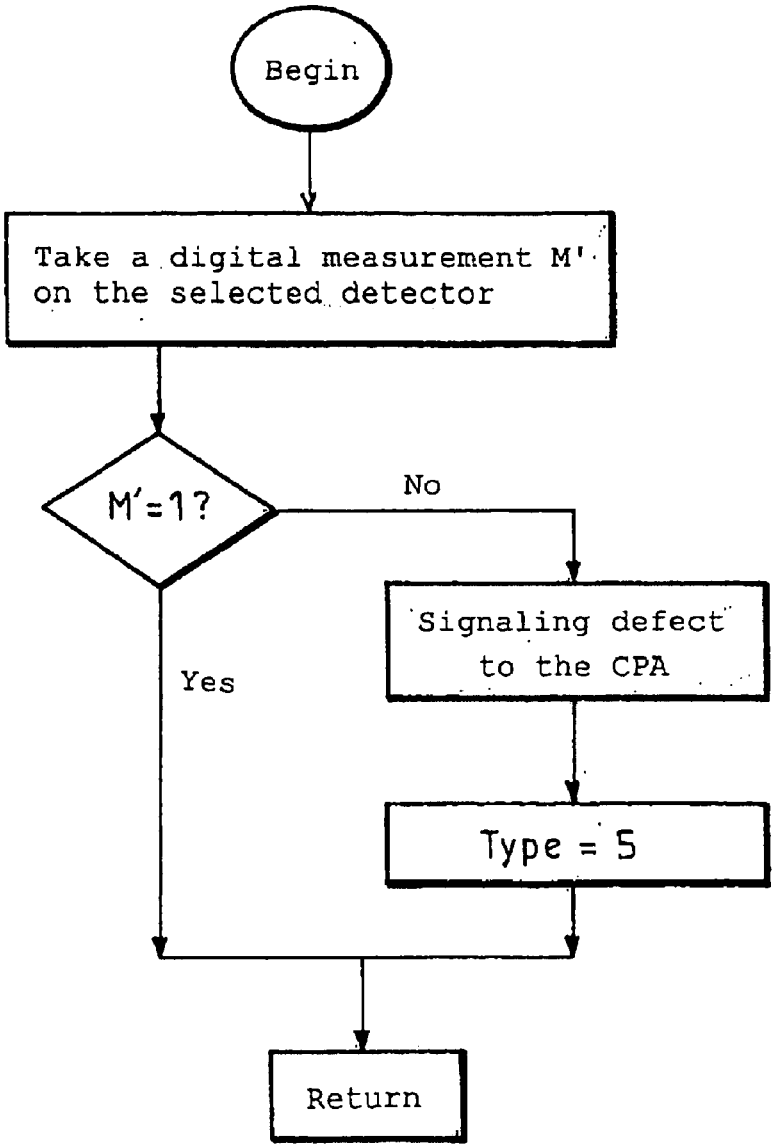
Figure 8D:
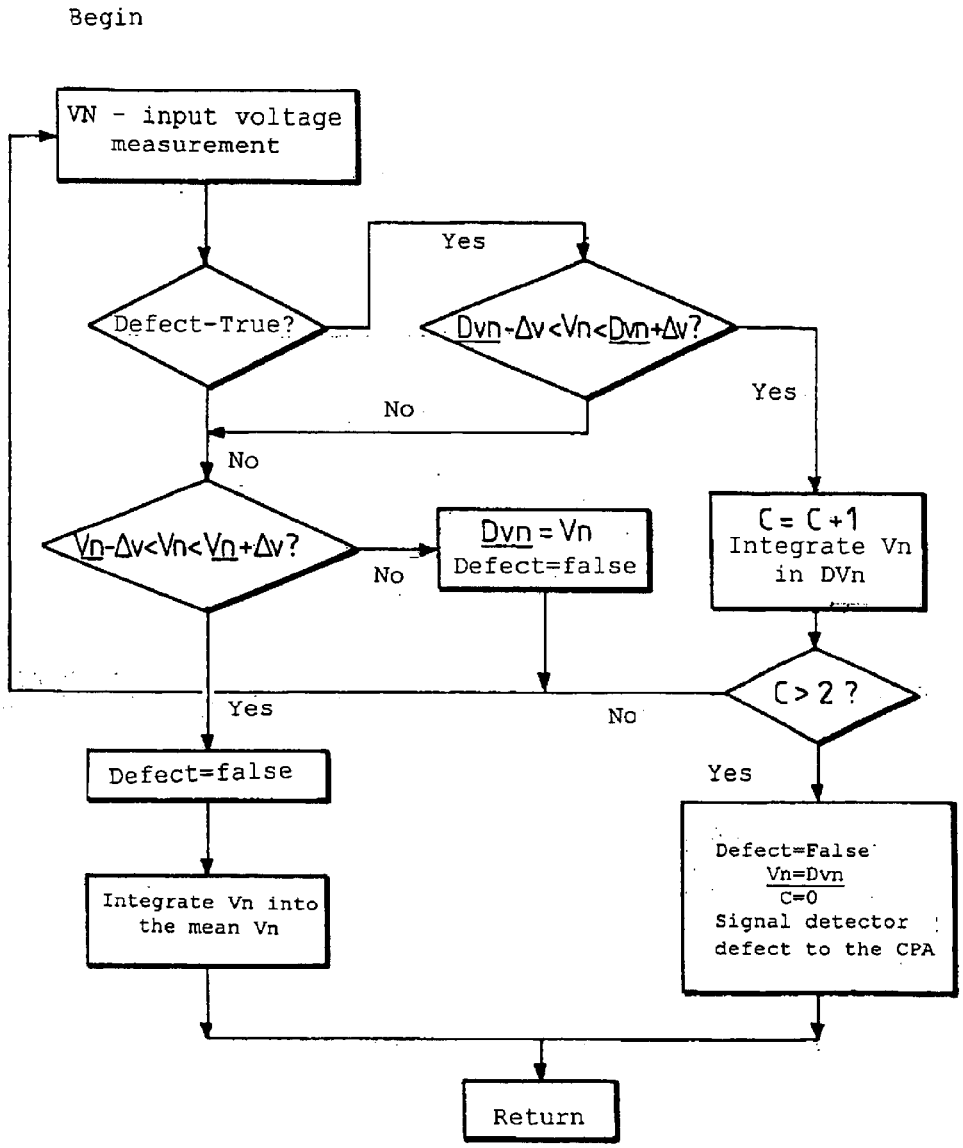
Figure 8E:
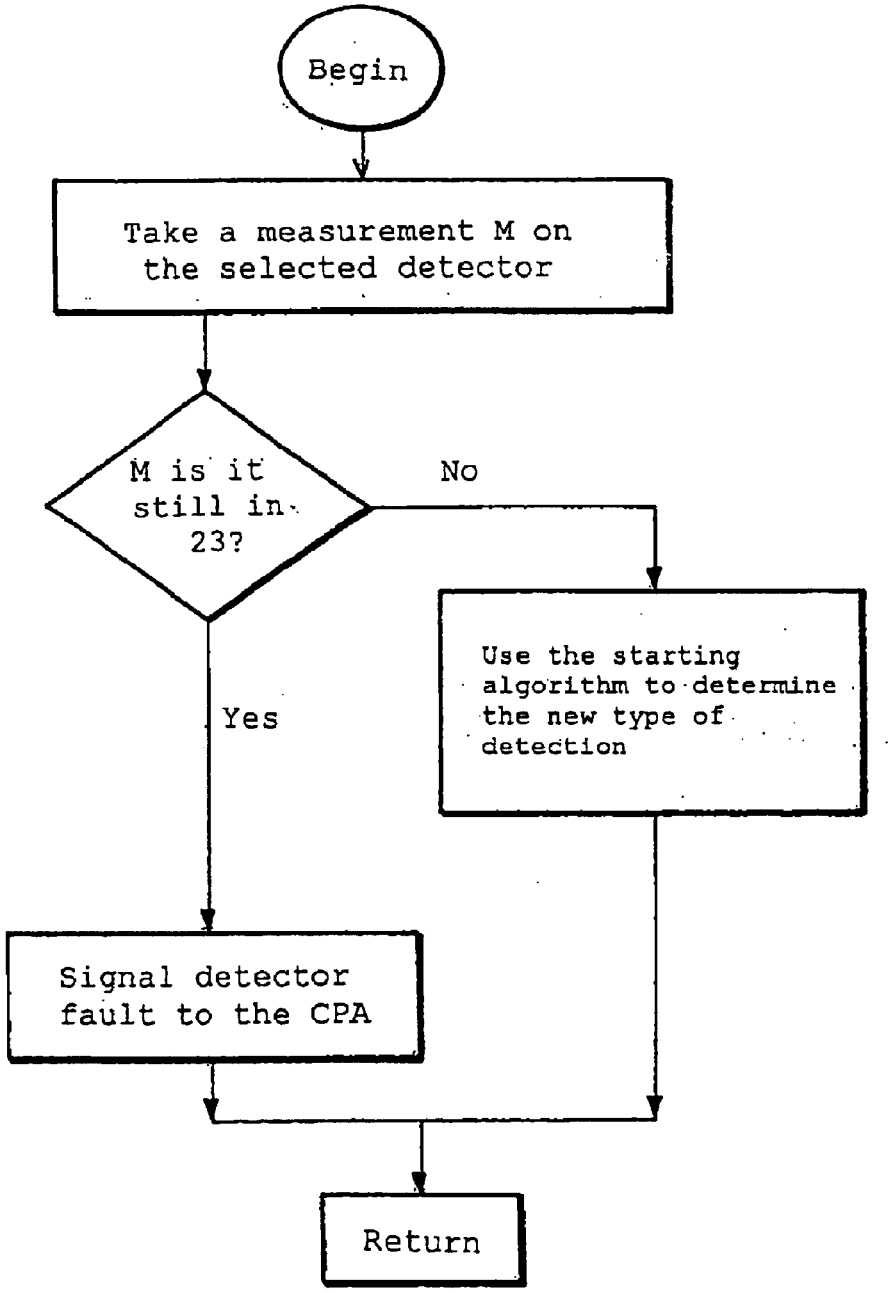
Figure 8F:
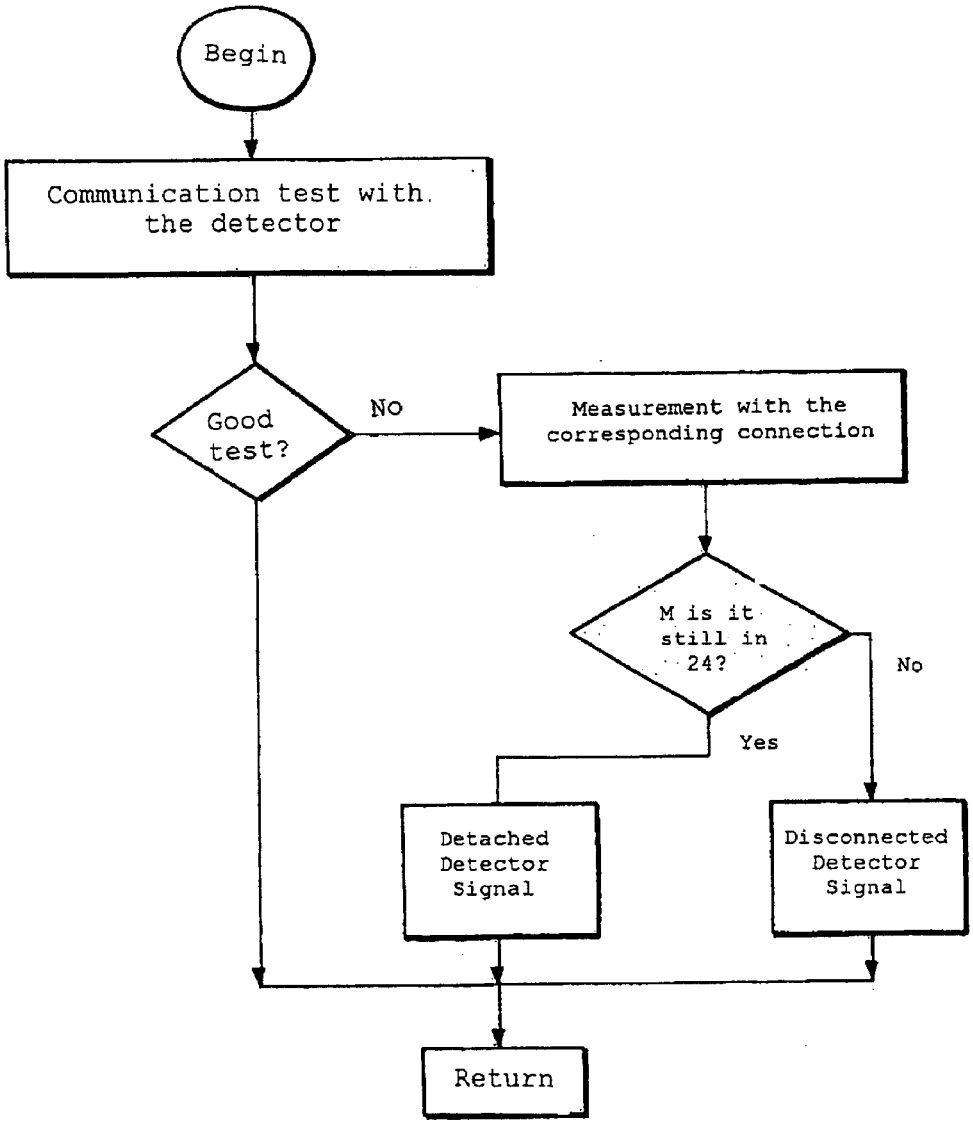
Figure 8G:
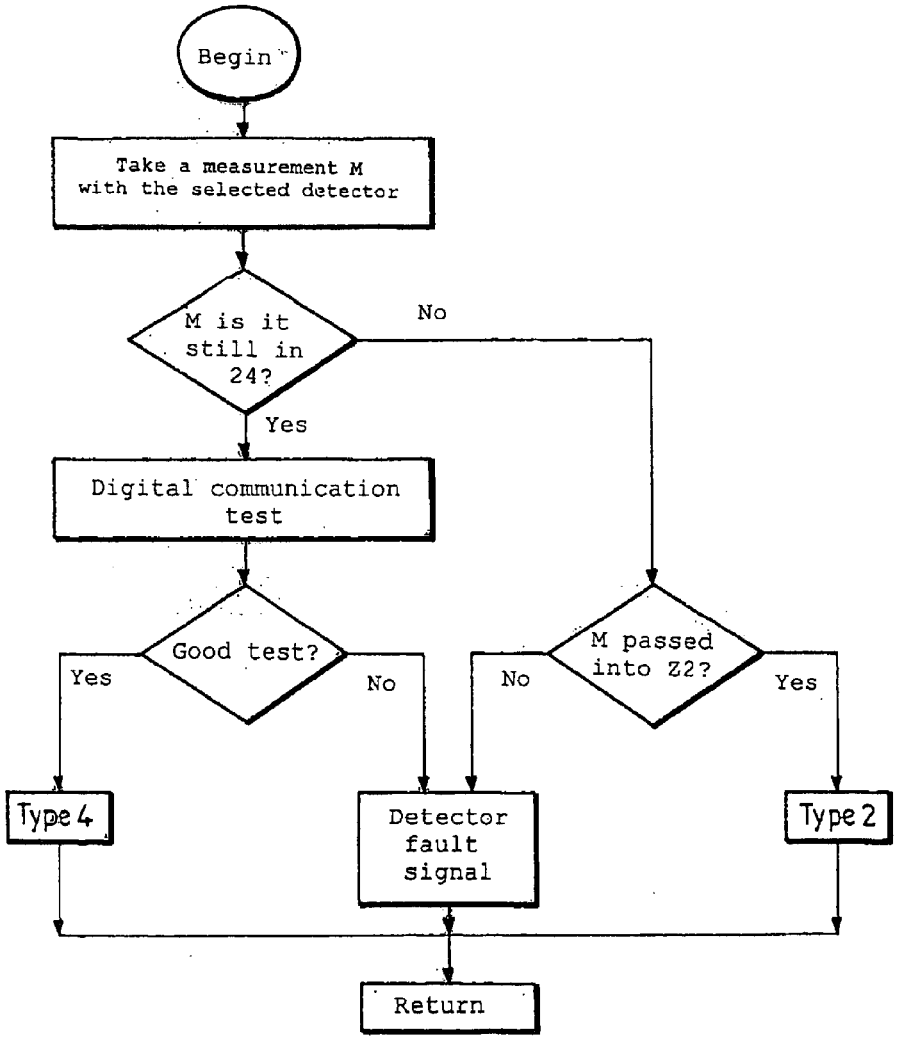
Figure 8H:
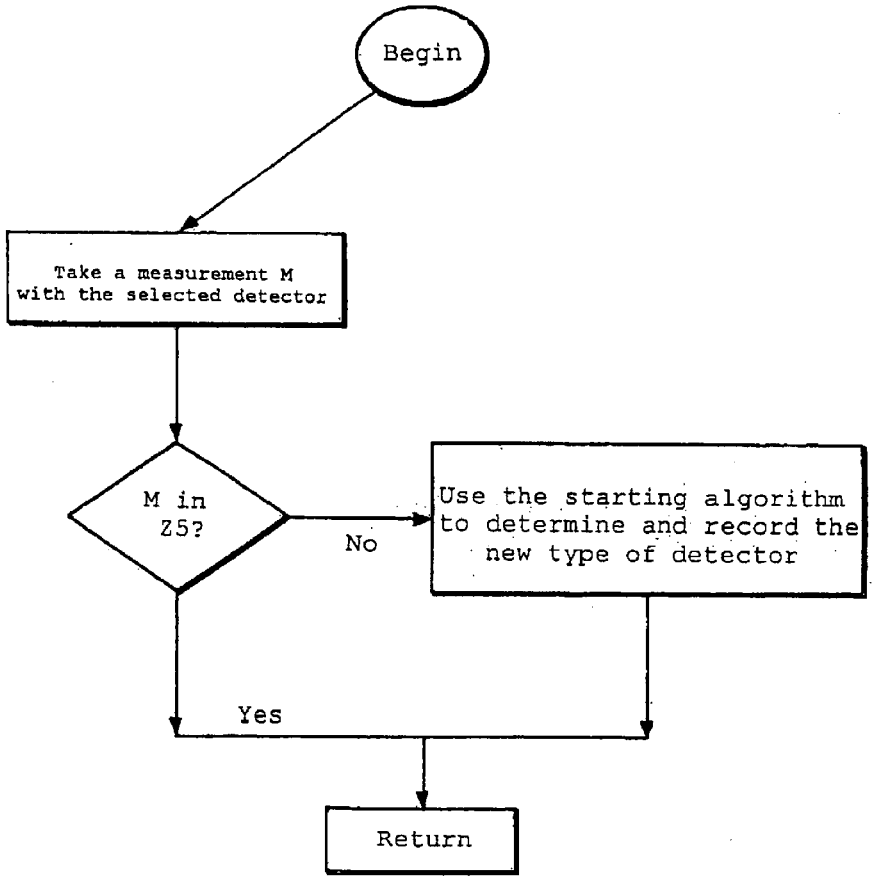

FIG. 8*a* corresponds to the initialisation of the system and in relation to the measurement M performed with respect to the different zones Z1 . . . Z5 possible, signals can be generated. The measurements may correspond to simple voltage measurements of the link (analogue passive or active detector) or voltage measurements enabling to determine data transmitted (communicating detector). The latter case corresponds to a communication test. In a particular embodiment, it is also possible to perform the communication test using the inputs/outputs of the microcontroller. FIG. 8*b* corresponds to the detectors readings. FIG. 8*c* corresponds to the interrogation of a digital detector. Preferably, one implements a software filtering module during the acquisition and the restitution of data in the dispatcher. FIG. 8*d* details the follow-up of the voltage by mobile average on a link. Preferably one implements a mobile average on 3 measures. The detection window is determined by the value Δv, a later measurement deviating from the mobile average +/−Δv being abnormal. FIG. 8*e* corresponds to the case of attempted sabotage (tampering). FIG. 8*f* corresponds to a digital detector, type 4. FIG. 8*g* corresponds to a detached analogue or digital detector. FIG. 8*h* corresponds to a detached absent detector or 'All or Nothing'.

Figure 3:
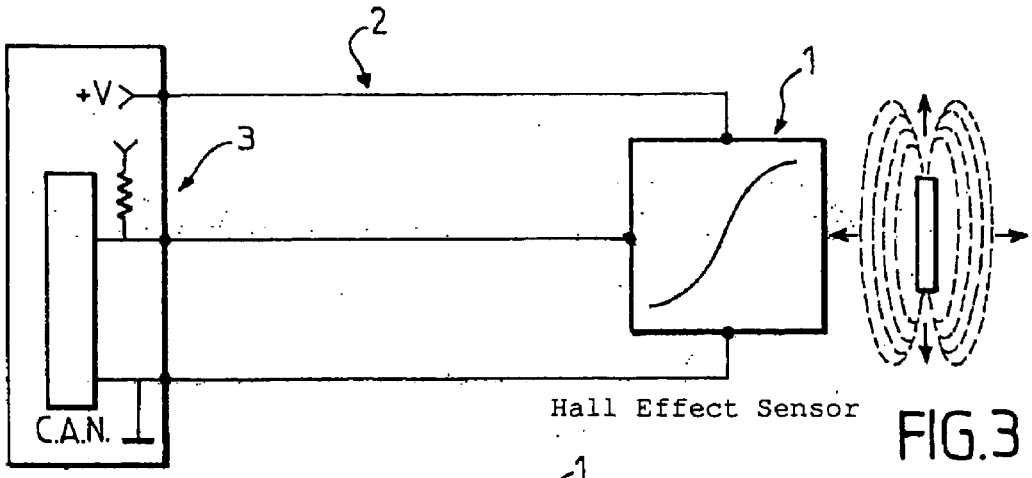
FIG. 3 represents the implementation of a detector with Hall effect sensor according to a first mode.
Figure 4:
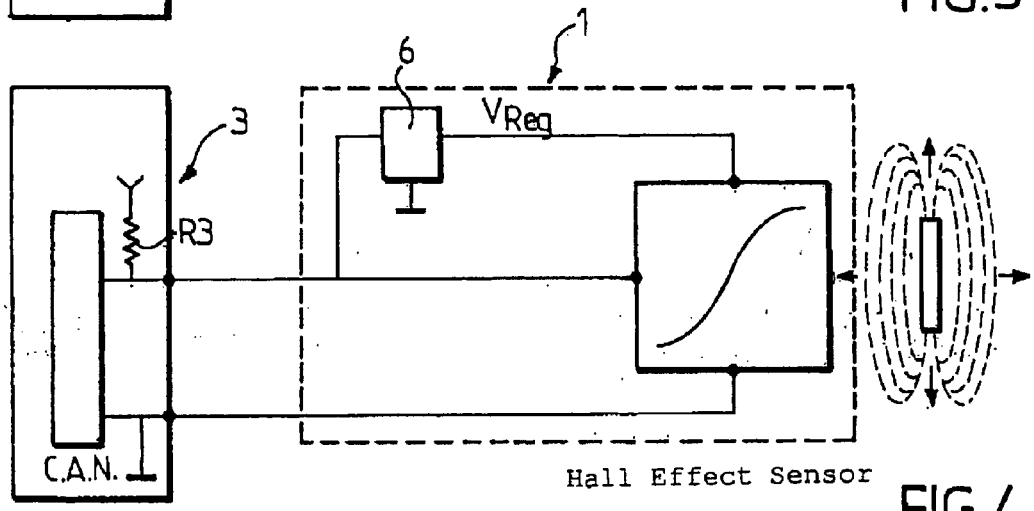
FIG. 4 represents the implementation of a detector with Hall effect sensor according to a second mode.
Figure 9A:
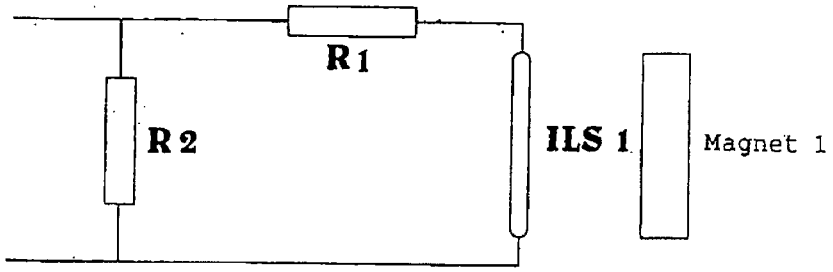
FIGS. 9*a* and 9*b* represent two other alternatives of detectors with flexible blade switch.
Figure 9B:
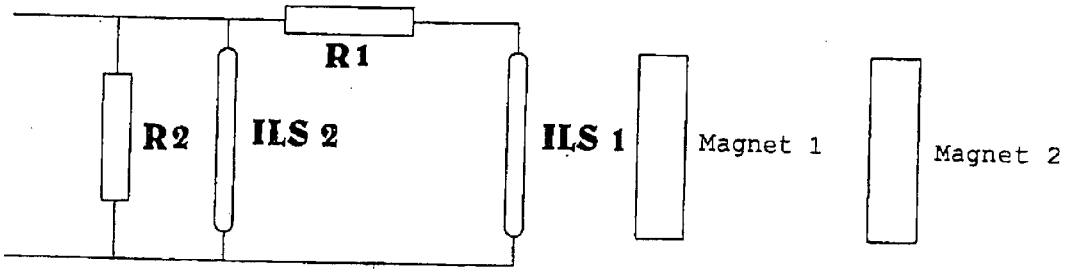

As previously described for exemplification purposes and in connection with FIG. 1, the sensor of the detector may be a switch (<<switch>>) or, in combination with FIGS. 3, 4 and 5, the sensor may be an active circuit sensitive to the magnetic field, such a Hall effect sensor. It is also possible to implement a switch which is sensible to a magnetic field, such as a flexible blade switch. It is thus that FIG. 9*a* represents a detector comprising a flexible blade switch which, in the presence of a magnet in relation with an object to be protected and positioned correctly, is stuck thus signalling the presence of the object. Such an assembly, although providing sufficient protection may, however, be subject to attempted neutralisation by implementation of a powerful magnet in the environment of the detector. There is therefore suggested more performing an assembly on FIG. 9*b* with two flexible blade switches, a first flexible blade switch 1 and a second flexible blade switch 2 in parallel of R1, i.e. arranged between both wires of the link) of the detector. The second flexible blade switch 2 is normally open since the field of the magnet 1 is sufficient to make the flexible blade switch 1 stick (when the object to be protected is in relation with the detector) but insufficient to make the flexible blade switch 2 stick. Conversely, if a person tries to neutralise the detector with a high field magnet 2, the flexible blade switch 2 will stick (short-circuiting the link and/or the flexible blade switch 1 will separate according to the direction and the respective intensities of the field of the magnets 1 and 2. In all cases, the signalling unit will indicate an anomaly causing an alarm. In this preferred example, one implements two simple and distinct flexible blade switches. It is also possible to implement other types of sensors such as a flexible blade switch with, in the same lamp, several flexible blades to obtain a reverting effect 1 towards 1 of 2 or two switches 1 towards 1 acting in relation to the direction of the magnetic field.

Finally, the detector is active and the electrical statuses are created by an active electronic circuit, the sensor being a sensor for measuring physical parameters such as, notably, force, displacement, tilt, capacity, said parameter measuring sensor being fixed to the object to be protected and that can be associated with a microcontroller in the detector.

What is claimed is:

1. A wire-based safety electronic device for the detection of the theft of an object to be protected, the device comprising at least one detector (1) connected by a wire-based electric link (2) to a signalling unit (3), the detector, having at least one electrical status, being arranged in relation with an object to be protected, the link transmitting the electrical status to the unit in the form of a voltage determined on the link, the signalling unit comprising at least a threshold voltage comparator with inputs/outputs whereof at least one input is connected to the detector by the link and whereof at least one output indicates by signals at least the presence or the absence of the object in relation to the electrical status of the detector, the link comprising two wires whereof a first is connected to a common point and the second is connected via at least one first resistor (R3) to a voltage generator with respect to the common point, the second wire being connected to the input of the comparator, the comparator comprising an analogue digital voltage converter (4) for digital measurements of the voltage and a digital calculation central unit controlled by an operating programme enabling the generation of signals in relation to the digital comparison between the measurement and digital reference thresholds, characterised in that the detector comprises a sensor and shows at least a first electrical status when the sensor is in relation with the object and a second electrical status when the object is detached from the sensor, and it comprises means to further generate a status linked with the absence or the presence of the detector on the link, a resistor being arranged between both wires of the link in the detector, in parallel with the sensor, the absence of the detector corresponding to a voltage at the input of the comparator approximately equal to the voltage of the voltage generator.

2. A device according to claim 1, characterised in that the digital reference thresholds are proportional to the voltage of the voltage generator.

3. A device according to claim 1, characterised in that the voltage generator is a fixed voltage regulator.

4. A device according to claim 1, characterized in that the voltage generator is a variable voltage regulator controlled by the calculation central unit, and preferably, an analogue digital converter.

5. A device according to claim 1, characterized in that the detector is passive and that the electrical statuses are created by variation of the resistor of the detector, the detector comprising a second resistor in series with the sensor which is a switch in mechanical association with the object, the assembly being connected between both wires of the link.

6. A device according to claim 1, characterized in that the detector is passive and that the electrical statuses are created by variation of the resistor of the detector, the sensor being a connector of both wires of the link intended to be connected to a socket of the object to be protected, the socket of the object exhibiting a load resistance.

7. A device according to claim 1, characterized in that the detector is passive and the electrical statuses are created by an active electronic circuit contained in the object to be protected, said electronic active circuit being connected to a socket of the object to be protected and the sensor is a connector of both wires of the link and intended to be connected to the socket of the object to be protected.

8. A device according to claim 1, characterized in that the detector is active and the electrical statuses are created by an active electronic circuit, the sensor being a Hall effect circuit in relation with a static magnetic field generator fixed to the object to be protected.

9. A device according to claim 1, characterised in that the detector is active and the electrical statuses are created by an active electronic circuit, the sensor being a sensor for measuring physical parameters, said parameter measuring sensor being fixed to the object to be protected and that can be associated with a microcontroller in the detector.

10. A device according to claim 1, characterized in that the detector is active and comprises at least one sensor which is a communicating electronic chip with power supply and with at least transmission of binary data on a two-wire-based link.

11. A device according to claim 1, characterized in that the detector is active and electric power supply of the detector is ensured by both-wire-based link.

12. A device according to claim 1, characterized in that the detector is active and the electric power supply of the detector is ensured by an additional wire in the wire-based link with recall of said power supply by a common wire.

13. A device according to claim 1, characterized in that in the case of an active detector, the resistor in parallel of the sensor is omitted, the load brought by the sensor causing a measureable voltage drop enabling the generation of the status linked with the absence or the presence of the detector on the link.

14. A wire-based safety electronic device for the detection of the theft of an object to be protected, the device comprising at least one detector (1) connected by a wire-based electric link (2) to a signaling unit (3), the detector, having at least one electrical status, being arranged in relation with an object to be protected, the link transmitting the electrical status to the unit in the form of a voltage determined on the link, the unit comprising at least a threshold voltage comparator with inputs/outputs whereof at least one input is connected to the detector by the link and whereof at least one output indicates by signals at least the presence or the absence of the object in relation to the electrical status of the detector, the link comprising two wires whereof a first is connected to a common point and the second is connected via at least one first resistor (R3) to a voltage generator with respect to the common point, the second wire being connected to the input of the comparator, the comparator comprising an analogue digital voltage converter (4) for digital measurements of the voltage and a digital calculation central unit controlled by an operating programme enabling the generation of signals in relation to the digital comparison between the measurement and digital reference thresholds, characterised in that the detector comprises a sensor and shows at least a first electrical status when the sensor is in relation with the object and a second electrical status when the object is detached from the sensor, and it comprises means to further generate a status linked with the absence or the presence of the detector on the link, a resistor being arranged between both wires of the link in the detector, in parallel with the sensor in that the digital reference thresholds are proportional to a mobile average calculated on a determined number of digital measurements of the voltage of the link.

15. An operating method of a theft detection device comprising at least one detector connected by a wire-based electrical link to a signalling unit, characterised in that the device is a wire-based safety electronic device for the detection of the theft of an object to be protected, the device comprising at least one detector (1) connected by a wire-based electric link (2) to a signaling unit (3), the detector, having at least one electrical status, being arranged in relation with an object to be protected, the link transmitting the electrical status to the unit in the form of a voltage determined on the link, the unit comprising at least a threshold voltage comparator with inputs/outputs whereof at least one input is connected to the detector by the link and whereof at least one output indicates by signals at least the presence or the absence of the object in relation to the electrical status of the detector, the link comprising two wires whereof a first is connected to a common point and the second is connected via at least one first resistor (R3) to a voltage generator with respect to the common point, the second wire being connected to the input of the comparator, the comparator comprising an analogue digital voltage converter (4) for digital measurements of the voltage and a digital calculation central unit controlled by an operating programme enabling the generation of signals in relation to the digital comparison between the measurement and digital reference thresholds, characterised in that the detector comprises a sensor and shows at least a first electrical status when the sensor is in relation with the object and a second electrical status when the object is detached from the sensor, and it comprises means to further generate a status linked with the absence or the presence of the detector on the link, a resistor being arranged between both wires of the link in the detector, in parallel with the sensor and that one converts the voltage of the link into digital value and that one performs a comparison of said value with at least one digital reference threshold in order to produce signals in relation to the status of the detector, one of the statuses being linked with the absence or the presence of the detector on the link, a resistor having been arranged between both wires of the link in the detector, in parallel of the sensor.

16. A method according to claim 15, characterised in that during an initialisation or addition/withdrawal phase of detector, one determines detection windows delineated by digital reference thresholds for the statuses transmitted by a link of a detector.

17. A method according to claim 15, characterized in that one determines the digital reference thresholds for a link and a given detector on the basis of a mobile average of measurements performed on said link and said detector for a given status.

18. A method according to claim 15, characterized in that one further determines the type of each detector of a given link during the first installation of the link and/or of each addition or withdrawal of detectors or when resetting.

19. A method according to claim 15, characterized in that one follows up the consumer's interest in the product.

* * * * *